US005747232A

United States Patent [19]

Anderson et al.

[11] Patent Number: 5,747,232

[45] Date of Patent: May 5, 1998

[54] MOTION IMAGING FILM COMPRISING A CARBON BLACK-CONTAINING BACKING AND A PROCESS SURVIVING CONDUCTIVE SUBBING LAYER

[75] Inventors: Charles C. Anderson, Penfield; Mario D. DeLaura, Hamlin, both of N.Y.

[73] Assignee: Eastman Kodak Company, Rochester, N.Y.

[21] Appl. No.: 806,371

[22] Filed: Feb. 27, 1997

[51] Int. Cl.[6] ..... G03C 1/825; G03C 1/85; G03C 1/835

[52] U.S. Cl. ..... 430/514; 430/513; 430/516; 430/527; 430/528; 430/530; 430/934

[58] Field of Search ..... 430/513, 514, 430/516, 527, 934, 528, 530

[56] References Cited

U.S. PATENT DOCUMENTS

| | | | |
|---|---|---|---|
| 2,271,234 | 1/1942 | Staud et al. | 430/513 |
| 2,327,828 | 8/1943 | Simmons | 430/513 |
| 2,976,168 | 3/1961 | Thompson et al. | 117/34 |
| 3,033,679 | 5/1962 | Laakso et al. | 430/527 |
| 3,437,484 | 4/1969 | Nadeau | 430/527 |
| 3,525,621 | 8/1970 | Miller | 430/527 |
| 3,630,740 | 12/1971 | Joseph | 430/529 |
| 3,681,080 | 8/1972 | Nakazawa et al. | 430/574 |
| 3,753,765 | 8/1973 | Morgan et al. | 430/527 |
| 3,881,932 | 5/1975 | Young | 430/220 |
| 4,070,189 | 1/1978 | Kelley et al. | 430/528 |
| 4,203,769 | 5/1980 | Guestaux | 430/527 |
| 4,237,194 | 12/1980 | Upson et al. | 430/527 |
| 4,275,103 | 6/1981 | Tsubusaki et al. | 430/67 |
| 4,301,239 | 11/1981 | Miller | 430/527 |
| 4,308,332 | 12/1981 | Upson et al. | 430/527 |
| 4,394,441 | 7/1983 | Kawaguchi et al. | 430/527 |
| 4,416,963 | 11/1983 | Takimoto et al. | 430/527 |
| 4,418,141 | 11/1983 | Kawaguchi et al. | 430/527 |
| 4,431,764 | 2/1984 | Yoshifumi | 524/409 |
| 4,495,276 | 1/1985 | Takimoto et al. | 430/527 |
| 4,526,706 | 7/1985 | Upson et al. | 430/527 |
| 4,542,095 | 9/1985 | Steklenski et al. | 430/527 |
| 4,571,361 | 2/1986 | Kawaguchi et al. | 428/328 |
| 4,845,369 | 7/1989 | Arakawa et al. | 250/484.1 |
| 4,914,011 | 4/1990 | Grous | 430/531 |
| 4,916,011 | 4/1990 | Miller | 430/527 |
| 4,990,434 | 2/1991 | Van Thillo et al. | 430/517 |
| 4,999,276 | 3/1991 | Kuwabara et al. | 430/527 |
| 5,006,451 | 4/1991 | Anderson et al. | 430/527 |
| 5,116,666 | 5/1992 | Konno | 428/220 |
| 5,122,445 | 6/1992 | Ishigaki | 430/527 |
| 5,221,598 | 6/1993 | Anderson et al. | 430/527 |
| 5,368,995 | 11/1994 | Christian et al. | 430/530 |
| 5,650,265 | 7/1997 | Sniadoch et al. | 430/527 |

FOREIGN PATENT DOCUMENTS 0 252 550 B1 3/1990 European Pat. Off. .

*Primary Examiner*—Richard L. Schilling
*Attorney, Agent, or Firm*—Carl F. Ruoff

[57] ABSTRACT

In accordance with this invention, a photographic film especially suited for motion imaging film applications such as motion picture film or television film has on one side of a support material, in order, a process surviving, electrically conductive subbing layer, a photographic emulsion, and a protective overcoat; and on the opposite side a carbon black-containing backing layer, and optionally, a lubricant that overlies the backing layer. The carbon black-containing layer provides antihalation and antistatic protection for the unprocessed film. The conductive subbing layer retains its antistatic properties after processing so that the motion imaging film is protected from the generation of static charge after the carbon black-containing layer is removed during processing. The conductive subbing layer has a resistivity of less than $5\times10^9$ Ω/□ after film processing.

14 Claims, No Drawings

MOTION IMAGING FILM COMPRISING A CARBON BLACK-CONTAINING BACKING AND A PROCESS SURVIVING CONDUCTIVE SUBBING LAYER

FIELD OF THE INVENTION

This invention relates to photographic film having on one side of a support material, in order, a conductive subbing layer, a photographic emulsion, and a protective overcoat; and on the opposite side, a carbon black-containing backing layer, and optionally, a lubricant that overlies the carbon black-containing layer. This photographic film is especially suited for use as a motion imaging film, for example, as a motion picture film or television film.

BACKGROUND OF THE INVENTION

Motion imaging films such as motion picture photographic films that are used as origination films (e.g., camera films and intermediate films, the latter being used to produce print films) and print films may use a carbon black-containing layer on the backside of the film. This backside layer provides both antihalation protection and antistatic properties. In addition, for the large rolls of film used in the motion picture and television industry the carbon black-containing backing layer also provides excellent protection from ferrotyping and blocking when the backing layer is in contact with the imaging side of the film, especially when the films are exposed to adverse conditions such as high humidity and temperature.

The carbon black is applied in an alkali-soluble binder that allows the layer to be removed prior to image development by a process that involves soaking the film in alkali solution, scrubbing the backside layer, and rinsing with water.

After removal of the carbon black-containing layer the film's antistatic properties are lost. Undesired static charge generation can then occur on processed motion picture and television films when transported through exposure equipment during the printing operation in the case of origination films and theater projectors in the case of motion picture print films, for example.

Such static charge generation and discharge can lead to several serious problems during the exposure of the print film from the intermediate film master and during movie theater projection of the motion picture print film. When static charges are generated on an intermediate film during the exposure of the print film, a static discharge may cause static marks in the print film. In addition, for origination films and print films high static charges generated during transport of the film can attract dirt particles to the film surface. Once on the film surface, these dirt particles can create abrasions and scratches. Origination films that contain such abrasions and scratches or, if sufficiently large, the dirt particles themselves, may transfer the image of these defects onto the print film during the printing operation. Print films may also generate static charge during the projection of the film in a movie theater which, again, may attract dirt particles to the film surface and ultimately result in projection of defects such as abrasions, scratches, or dirt particles onto the movie theater screen.

Thus it is highly desirable to provide an improved motion imaging film having antihalation, antiferrotyping, antiblocking, and antistatic properties before processing and antistatic properties that survive film processing.

To overcome the problem of static charges, it is conventional practice to provide an antistatic layer on photographic films. Many antistatic agents have been utilized for the purpose. For example, an antistatic layer comprising an alkali metal salt of a copolymer of styrene and styrylundecanoic acid is disclosed in U.S. Pat. No. 3,033,679. Photographic films having a metal halide, such as sodium chloride or potassium chloride, as the conducting material, in a hardened polyvinyl alcohol binder are described in U.S. Pat. No. 3,437,484. In U.S. Pat. No. 3,525,621, the antistatic layer is comprised of an alkyaryl polyether sulfonate, an alkali metal salt of an arylsulfonic acid, or an alkali metal salt of a polymeric carboxylic acid. An antistatic layer comprised of an anionic film forming polyelectrolyte, colloidal silica and a polyalkylene oxide is disclosed in U.S. Pat. No. 3,630,740. In U.S. Pat. No. 3,681,080, an antistatic layer is described in which the antistatic agent is a copolymer of styrene and styrenesulfonic acid. U.S. Pat. No. 4,542,095 describes antistatic compositions comprising a binder, a nonionic surface-active polymer having polymerized alkylene oxide monomers and an alkali metal salt. In U.S. Pat. No. 4,916,011, an antistatic layer comprising a styrene sulfonate-maleic acid copolymer, a latex binder, and a alkyl-substituted trifunctional aziridine cross-linking agent is disclosed. U.S. Pat. Nos. 4,237,194, 4,308,332, and 4,526,706 describe antistats based on polyaniline salt-containing layers. Crosslinked vinylbenzyl quaternary ammonium polymer antistatic layers are described in U.S. Pat. No. 4,070,189.

The use of vanadium pentoxide antistatic layers is well known in the literature. The preparation of an antistatic layer from a composition of vanadium pentoxide colloidal gel is described in U.S. Pat. Nos. 4,203,769, 5,006,451, 5,221,598 and 5,368,995, and others. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology. A polymer binder, such as a vinylidene chloride-containing terpolymer latex or a polyesterionomer dispersion, is preferably employed to improve the integrity of the antistatic layer and to improve adhesion to the underlying support material.

The antistatic layer of vanadium pentoxide is known to interact with components in the processing solutions. Frequently, the chemicals in the photographic processing solutions are capable of reacting with or solubilizing the conductive compounds in an antistatic layer, thus causing a diminution or complete loss of the desired antistatic properties. The result of this interaction is the loss of conductivity of the antistatic layer, thus the loss of dirt protection that a process surviving antistatic layer provides post-processed film. To provide protection of the antistatic layer from interacting with components of the processing solutions, a protective overcoat or barrier layer is applied to the antistatic layer.

Antistatic layers comprising electronically-conductive metal-containing particles have been described. Examples of useful electrically conductive metal-containing particles include donor-doped metal oxides, metal oxides containing oxygen deficiencies, and conductive nitrides, carbides, and bromides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995. Also included are fibrous conductive powders comprising, for example, antimony-doped tin oxide coated onto non-conductive potassium titanate whiskers as described in U.S. Pat. Nos. 4,845,369 and 5,116,666.

European Patent Application A252550 describes a motion picture print film element comprising a transparent support coated thereon, in succession, a blue-sensitive silver halide emulsion layer, a red-sensitive silver halide emulsion layer, an intermediate layer, a green-sensitive silver halide emulsion layer, and an antistress layer, wherein between the support and the blue-sensitive emulsion layer is a yellow antihalation layer and between the blue-sensitive emulsion layer and the red-sensitive emulsion layer is a blue antihalation layer. This application also describes an antistatic layer comprising an electroconductive polymer such as a polystyrene sulphonic acid sodium salt on the side of the support opposite to the photographic emulsion. Without a protective topcoat the antistatic performance of these electroconductive polymers may be greatly diminished after processing.

Photographic films utilizing a carbon black-containing layer are described in U.S. Pat. Nos. 2,271,234, 2,327,828, 2,976,168, 3,753,765, 3,881,932, 4,301,239, 4,914,011, and 4,990,434, for example. The use of other layers on the photographic emulsion side of the support are disclosed, including subbing layers, interlayers, and filter layers. However, these prior art references for photographic films utilizing a carbon black-containing layer do not teach the use and benefit of additionally using a conductive subbing layer whose antistatic properties survive film processing on the side of the support opposite to the carbon black-containing layer.

Although the aforementioned prior references describe some of the features of the present invention they do not teach or provide an adequate solution to the demanding requirements for an improved motion imaging film.

SUMMARY OF THE INVENTION

In accordance with this invention, a photographic film especially suited for motion imaging film applications such as motion picture film or television film has on one side of a support material, in order, a process surviving, electrically conductive subbing layer, a photographic emulsion, and a protective overcoat; and on the opposite side a carbon black-containing backing layer, and optionally, a lubricant that overlies the backing layer. The carbon black-containing layer provides antihalation and antistatic protection for the unprocessed film. The conductive subbing layer retains its antistatic properties after processing so that the motion imaging film is protected from the generation of static charge after the carbon black-containing layer is removed during processing. The conductive subbing layer has a resistivity of less than $5\times10^9$ Ω/□ after film processing.

DETAILED DESCRIPTION OF THE INVENTION

This invention relates to a photographic film that has on one side of a support material, in order, a process surviving, conductive subbing layer, a photographic emulsion, and a protective overcoat; and on the opposite side a carbon black-containing backing layer, and optionally, a lubricant layer that overlies the backing layer. This photographic film is especially suited for motion imaging film applications such as motion picture film or television film.

The photographic film supports materials used in the practice of this invention are synthetic high molecular weight polymeric materials. These support materials may be comprised of various polymeric films, paper and the like, but polyester and triacetate film supports, which are well known in the art, are preferred. The thickness of the support is not critical. Support thickness of 2 to 10 mils (0.002–0.010 inches) can be employed, for example, with very satisfactory results. The polyester support typically employs an undercoat or primer layer between the conductive subbing layer and the polyester support. Such undercoat layers are well known in the art and comprise, for example, a vinylidene chloride/methyl acrylic acid/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

The carbon black-containing backing layer comprises an alkali-soluble polymer binder, conductive carbon black, and other optional ingredients such as dispersing aids, surfactants, lubricants, coalescing aids, and matte beads, for example. Suitable alkali-soluble polymer binders for use in the carbon black-containing layer include copolymers of alkyl (meth)acrylates and (meth)acrylic acid, polyvinyl phthalates, cellulose organic acid esters containing dicarboxylic acid groups such as cellulose acetate phthalate, cellulose acetate maleate, cellulose acetate proprionate phthalate, cellulose acetate proprionate succinate, and others. Various conductive carbon blacks such as those described in "Carbon Black", J. B. Donnet and A. Voet, Marcel Dekker (1976) may be successfully employed in the backing layer.

The dry coating weight of the carbon black-containing layer is typically 200 to 5000 mg/m$^2$. The amount of carbon black contained in the layer is such that the backing layer has an optical density of greater than 0.5 and a resistivity of less than $1\times10^8$ Ω/□ in order to provide sufficient antihalation and antistatic protection for the unprocessed film. The carbon black-containing layer may be applied directly onto the polymeric film support or onto a primer layer that was previously applied onto the film support. For polyester film support it is preferable that the backing layer is applied directly onto the film support following an energy treatment such as corona discharge treatment.

Optionally, a lubricant is applied over the carbon black-containing layer in order to better control the frictional characteristics of the backside of the film. The lubricant is applied either from aqueous or organic solvent medium. Lubricants that can be effectively employed include higher alcohol esters of fatty acids, higher fatty acid calcium salts, metal stearates, silicone compounds, paraffin waxes, and natural waxes such as carnauba wax and bees wax as described in U.S. Pat. Nos. 2,588,756, 3,121,060, 3,295,979, 3,042,522 and 3,489,567 and others.

The conductive subbing layer of the invention may be a single layer containing a conductive agent that is inherently stable toward photographic processing solutions or the conductive subbing layer may be overcoated with a barrier layer to protect the conductive subbing layer from processing solutions. The conductive subbing layer has a resistivity of less than $5\times10^9$ Ω/□ after film processing.

Preferably, the conductive subbing layer is used as a single layer without the need for an additional barrier layer to preserve antistatic properties after processing. In this case, preferred conductive agents for use in the conductive subbing layer include;

(1) electrically conductive metal-containing particles including donor-doped metal oxides, metal oxides containing oxygen deficiencies, and conductive nitrides, carbides, and bromides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TaB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995.

(2) fibrous conductive powders comprising, for example, antimony-doped tin oxide coated onto non-conductive potassium titanate whiskers as described in U.S. Pat. Nos. 4,845,369 and 5,116,666 and antimony-doped tin oxide fibers or "whiskers" as described in pending U.S. application Ser. No. 08/747,480 and U.S. application Ser. No. 08/746,618 filed Nov. 12, 1996.

(3) the electronically-conductive polyacetylenes, polythiophenes, and polypyrroles of U.S. Pat. Nos. 4,237,194, 5,370,981, and Japanese Patent Applications 2282245 and 2282248.

The above mentioned conductive agents are applied with a polymeric binder. Various polymer binders may be used to form the layer such as gelatin, cellulosics, polyurethanes, polyesters, interpolymers of ethylenically unsaturated monomers such as (meth)acrylic acid and its esters, styrene and its derivatives, vinyl chloride, butadiene, and others. However, it is preferable to employ gelatin as the binder in order to promote optimum adhesion to the photographic emulsion that overlies the conductive subbing layer.

Conductive agents that are soluble in or otherwise affected by film processing solutions without an overlying barrier layer may also be effectively employed in the present invention when a barrier layer is interposed between the conductive subbing layer and the photographic emulsion. Such conductive agents include the ionically-conductive cross-linked vinylbenzyl quaternary ammonium polymers of U.S. Pat. No. 4,070,189 or the electronically-conductive colloidal gel of vanadium pentoxide or silver-doped vanadium pentoxide as described in U.S. Pat. Nos. 4,203,769, 5,006,451, 5,221,598 and 5,284,714. Useful barrier layers are those that are described in U.S. Pat. Nos. 5,006,451 and 5,221,598, for example.

In addition to the conductive agent and polymer binder, the conductive subbing layer optionally includes coating aids, dispersants, hardeners and crosslinking agents, and matte beads.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type-of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The protective overcoat that overlies the photographic emulsion layer comprises gelatin, matte beads, lubricants, coating aids, surfactants, including fluoro surfactants, and optional addenda well known in the art such as hardeners, polymer latexes, synthetic polymers such as polyacrylamides, polyvinyl pyrrolidone, and others.

The following examples are intended to illustrate the present invention more practically but not to limit it in scope in any way.

EXAMPLES 1 TO 6 AND COMPARATIVE SAMPLES A TO D

A polyester support was prepared by first applying a primer layer of a terpolymer of acrylonitrile, vinylidene chloride and acrylic acid to one side of the support before drafting and tentering so that the final coating weight is about 90 mg/m$^2$.

Conductive subbing layer coating formulations consisting of the following components are prepared at 1.5 to 3 weight % total solids:

gelatin;

conductive zinc antimonate particles or antimony-doped tin oxide particles (each with an avg particle size of about 50 nm);

saponin surfactant;

potassium chrome alum hardener;

0.8 μm polymer matte beads;

demineralized water.

The conductive subbing layer coating compositions were applied onto the terpolymer primer layer and dried at 120° C. The subbing layers had a weight loading of zinc antimonate particles of 80 to 90 weight percent of total solids and the coatings were applied at a dry coating weight of 150 to 400 mg/m$^2$.

A carbon black-containing layer having an alkali-soluble binder was applied onto the side of the support opposite to that of the conductive subbing layer. The carbon black-containing layer had a dry coating weight of 700 mg/m$^2$, an optical density of 1.2, and a surface resistivity at 50 percent RH as measured by a two-point probe equal to $4\times10^7$ ω/□.

The conductive subbing layer was then overcoated with a color motion picture film emulsion and a conventional emulsion overcoat containing 1000 mg/m$^2$ gelatin, 5 mg/m$^2$ of 2 μm polymer matte, and polydimethyl siloxane lubricant was applied over the emulsion.

The film samples were evaluated for dry and wet adhesion of the emulsion layer to the conductive subbing layer using the following tests. Dry adhesion was determined by scribing a cross-hatch pattern on the emulsion side of the support, applying a piece of high tack tape to the surface of the film, and quickly pulling the tape from the film sample. The extent of emulsion layer removal is a measure of dry adhesion. Wet adhesion was determined by soaking the sample in film developer for 30 seconds and then vigorously rubbing the film surface with a finger, the extent of emulsion layer removal is a measure of wet adhesion.

The films were processed in a conventional motion picture film processor and the internal resistivity of the films (internal resistivity measured according to: R.A. Elder, Proc. EOS/ESD Sympos., EOS-12, pgs 251–4, September 1990) were determined after removal of the carbon black-containing layer.

In addition, the film samples were evaluated for sensitometry and image quality as determined by measurements of their Dmin values, halation latitude, sharpness, and granularity. Films of the invention were found to have excellent sensitometry and image quality in these tests.

The description for the film samples and the results obtained for adhesion and resistivity are shown in Table 1.

TABLE 1

| Film | Subbing layer description* | Dry Adhesion | Wet Adhesion | Resistivity Ω/□ |
|---|---|---|---|---|
| Sample A | conventional, gelatin only | excellent | excellent | $>10^{14}$ |
| Sample B | 225 mg/m$^2$, zinc antimonate/gelatin = 80/20 | excellent | excellent | $1.6\times10^{10}$ |
| Sample C | 400 mg/m$^2$, tin oxide/gelatin = 85/15 | excellent | excellent | $6.3\times10^9$ |
| Sample D | 300 mg/m$^2$, tin oxide/gelatin = 85/15 | excellent | excellent | $1.2\times10^{10}$ |
| Example 1 | 150 mg/m$^2$, zinc antimonate/gelatin = 85/15 | excellent | excellent | $1.2\times10^9$ |
| Example 2 | 150 mg/m$^2$, zinc antimonate/gelatin 90/10 | excellent | excellent | $2.5\times10^8$ |
| Example 3 | 300 mg/m$^2$, zinc antimonate/gelatin = 80/20 | excellent | excellent | $5.0\times10^8$ |
| Example 4 | 300 mg/m$^2$, zinc antimonate/gelatin = 90/10 | excellent | excellent | $1.5\times10^8$ |
| Example 5 | 300 mg/m$^2$, tin oxide/gelatin = 90/10 | excellent | excellent | $1.3\times10^9$ |
| Example 6 | 400 mg/m$^2$, tin oxide/gelatin = 90/10 | exaellent | excellent | $5.0\times10^8$ |

*total dry coating weight and weight ratio of conductive agent to gelatin.

The effectiveness of the antistatic protection for the above film samples after processing was also evaluated by the following practical test. A transport process was simulated by running developed film in a loop (~ 2 m long) at a speed of 30 m/min. In this practical test the film was charged, the resultant electric field measured, and an attempt was made to attract highly charged particles to the moving film.

The surface of the emulsion side of the film was charged by passing the film between a radioactive source connected to a high voltage power supply located on one side of the film and a grounded metal plate located on the other side. Approximately 18 cm beyond the charging device, a non-contacting fieldmeter was used to measure the electric field. A small glass dish containing highly charged particles was located approximately 22 cm beyond the fieldmeter.

After charging the web to an equilibrium electric field level, the charged particles were slowly moved towards the film by means of a scissors jack until particles in the glass dish were attracted to the film.

The results found show that above approximately $5\times10^9$ Ω/□, that is, for Comparative sample A to D, it was possible to charge the web to a level that resulted in an external electric field strong enough to attract particles. Below $5\times10^9$ Ω/□ that is for Examples 1 t 6 of the invention, it was not possible to charge the film sufficiently to attract particles.

It has been clearly shown that films of the invention comprising a process surviving conductive subbing layer having a resistivity after processing of less than $5\times10^9$ Ω/□/ and a carbon black-containing backing layer provide improved performance for motion imaging films. Although a variety of conductive agents have been described for use in conductive layers including subbing layers for a wide variety of film products the prior art does not teach the benefits found in the present studies in which a motion imaging film that utilizes both a carbon black-containing backing layer to provide antihalation and antistatic protection for the raw film and a process surviving conductive subbing layer to provide antistatic protection for the processed film.

While there has been shown and described what are at present considered the preferred embodiments of the invention, it will be obvious to those skilled in the art that various modifications may be made therein without departing from the scope of the invention as defined by the appended claims. All such modifications are intended to be included in the present invention.

What is claimed is:

1. A motion imaging film comprising:

a support having, in order, on one side thereof a process surviving electrically conductive layer, at least one silver halide emulsion layer and a protective overcoat; and having, in order, on the opposite side thereof a carbon black-containing backing layer comprising an alkali-soluble polymer binder and conductive carbon black, wherein the process surviving electrically conductive layer has a resistivity of less than $5\times10^9$ Ω/□.

2. The motion imaging film as claimed in claim 1, wherein said support is a polyester film.

3. The motion imaging film as claimed in claim 2, further comprising a primer layer between the support and the process surviving electrically conductive layer comprising a vinylidene chloride/methyl acrylic acid/itaconic acid terpolymer or vinylidene chloride/acrylonitrile/acrylic acid terpolymer.

4. The motion imaging film as claimed in claim 1, wherein said support is a cellulose triacetate film.

5. The motion imaging film as claimed in claim 1, wherein the alkali-soluble polymer binder is selected from the group consisting of copolymers of alkyl (meth)acrylates and (meth)acrylic acid, polyvinyl phthalates, and cellulose organic acid esters containing dicarboxylic acid.

6. The motion imaging film as claimed in claim 1, wherein said carbon-black containing backing layer further comprises dispersing aids, surfactants, lubricants, coalescing aids, and matte beads.

7. The motion imaging film as claimed in claim 1, wherein the process surviving electrically conductive layer comprises electrically conductive metal-containing particles selected from the group consisting of donor-doped metal oxides, metal oxides containing oxygen deficiencies, conductive nitrides, conductive carbides, and conductive bromides and a polymer binder.

8. The motion imaging film as claimed in claim 1, wherein the process surviving electrically conductive layer comprises fibrous conductive powders and a polymer binder.

9. The motion imaging film as claimed in claim 1, wherein the process surviving electrically conductive layer comprises electronically-conductive polyacetylenes, polythiophenes, and polypyrroles and a polymer binder.

10. The motion imaging film as claimed in claim 1, wherein the process surviving electrically conductive layer further comprises a conductive agent and binder that is affected by film processing solutions and a barrier layer interposed between the conductive agent and binder and the silver halide emulsion layer.

11. The motion imaging film as claimed in claim 10, wherein the conductive agents are selected from the group consisting of ionically-conductive cross-linked vinylbenzyl quaternary ammonium polymers, electronically-conductive colloidal gel of vanadium pentoxide, and silver-doped vanadium pentoxide.

12. The motion imaging film as claimed in claim 1, wherein the process surviving electrically conductive layer further comprises coating aids, dispersants, hardeners, crosslinking agents and matte beads.

13. The motion imaging film as claimed in claim 1, wherein the protective overcoat comprises gelatin, matte beads, lubricants, coating aids, surfactants, hardeners, polymer latexes, and synthetic polymers.

14. The motion imaging film as claimed in claim 1, further comprising a lubricant superposed on the carbon black containing backing layer.

* * * * *